United States Patent [19]

Nash et al.

[11] 4,231,481

[45] Nov. 4, 1980

[54] CONVERTIBLE CONTAINER FOR FLUENT OR SOLID CARGO

[75] Inventors: Gilbert J. Nash, Edmonds; Gerhard E. Seidel, Renton, both of Wash.

[73] Assignee: Boeing Commercial Airplane Company, Seattle, Wash.

[21] Appl. No.: 29,607

[22] Filed: Apr. 13, 1979

[51] Int. Cl.[3] ..... B65D 88/12; B65D 90/04

[52] U.S. Cl. ..... 220/1.5; 206/577; 220/4 F; 220/85 B; 220/403; 220/445; 220/461

[58] Field of Search ..... 206/583, 577; 220/403, 220/404, 437, 445, 446, 447, 448, 85 B, 461, 1 S, 4 F; 248/603, 604, 675, 674

[56] References Cited

U.S. PATENT DOCUMENTS

| | | | |
|---|---|---|---|
| 1,503,167 | 7/1924 | Mills | 220/445 X |
| 2,335,779 | 11/1943 | Mazzei | 206/583 X |
| 2,477,606 | 8/1949 | Hudson | 220/85 B X |
| 2,779,464 | 1/1957 | Cairnes et al. | 206/583 |
| 2,868,519 | 1/1959 | Tocci | 220/403 X |
| 3,005,317 | 10/1967 | Bunn | 220/85 B X |
| 3,098,562 | 7/1963 | Simmons | 270/1.5 X |
| 3,112,845 | 12/1963 | Bryant | 220/85 B X |
| 3,172,556 | 3/1965 | Stiefel | 220/85 B X |
| 3,583,330 | 6/1971 | Frendmon et al. | 220/85 B X |
| 3,623,626 | 11/1971 | Bridges | 220/437 |
| 3,658,205 | 4/1972 | Kassravi | 220/85 B X |
| 3,727,795 | 4/1973 | Willsey | 220/85 B X |
| 3,752,354 | 8/1973 | Demiras | 220/85 B X |
| 3,834,174 | 9/1974 | Strumbos | 220/27.1 X |
| 3,844,203 | 10/1974 | Takahashi | 220/448 X |
| 3,913,775 | 10/1975 | Ozaki | 220/437 X |
| 3,918,604 | 11/1975 | Kerstern | 220/85 B X |

FOREIGN PATENT DOCUMENTS

| | | | |
|---|---|---|---|
| 1390518 | 4/1975 | United Kingdom | 220/85 B |

*Primary Examiner*—Allan N. Shoap

*Attorney, Agent, or Firm*—Ronald E. Suter; Bernard A. Donahue

[57] ABSTRACT

An intermodal cargo container capable of being quickly and easily converted between a solid storage mode and a fluent storage mode is disclosed. Shell sections adapted to be either removed from, or pivoted within, an outer container are provided to support an impermeable liner in the fluent storage mode. Elements of both the inner and outer container may be of conventional construction for surface transport or of lightweight construction suitable for air as well as surface transport.

12 Claims, 8 Drawing Figures

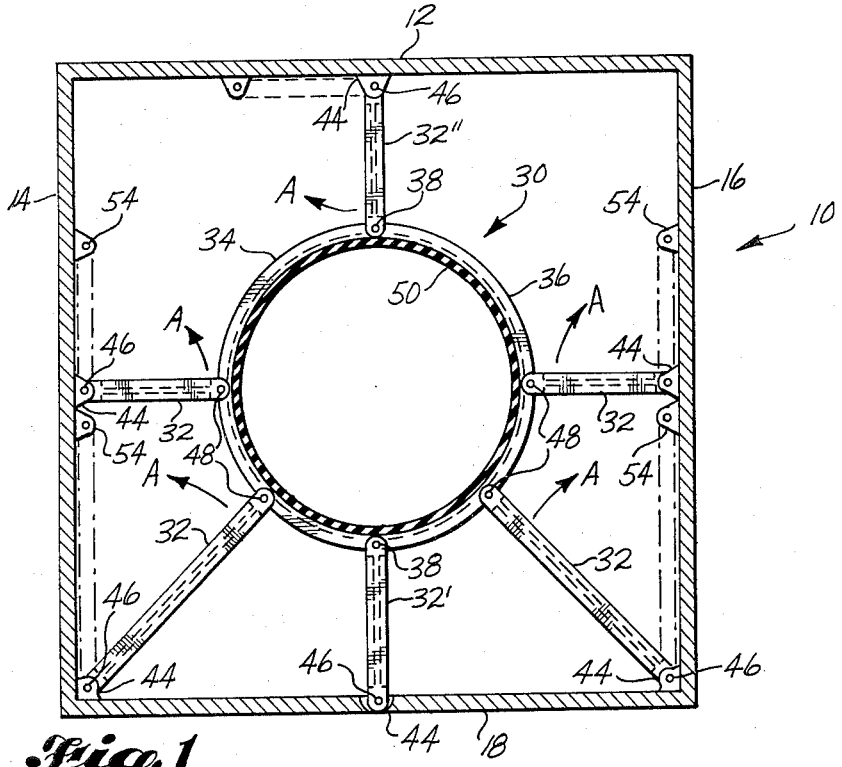
Fig. 1
Fig. 2
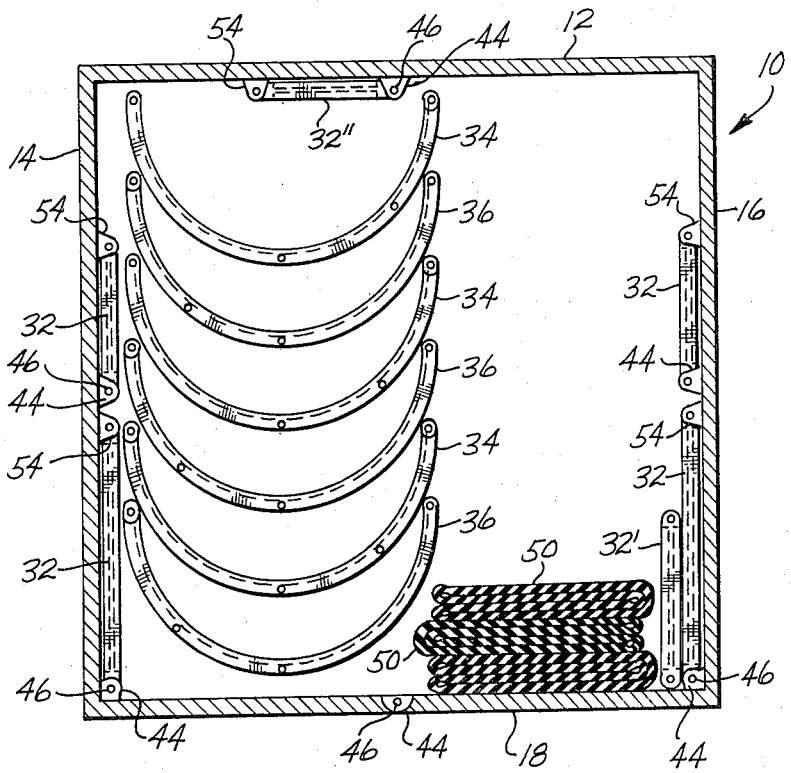

CONVERTIBLE CONTAINER FOR FLUENT OR SOLID CARGO

BACKGROUND OF THE INVENTION

1. Field of the Invention

This invention relates generally to the field of cargo transport. More specifically, this invention is concerned with cargo containers that may be converted to carry a wide variety of material having different characteristics and densities. The present invention finds particularly useful application in the field of containerized cargo using so-called intermodal containers. It should be clear that the advantages of the invention are equally manifest in various types and sizes of containers.

2. Background of the Invention

Two of the major problems faced by the cargo industry were the desire to quickly transfer cargo from one mode of transport to another and the so-called "backhaul" or "deadhead" problem created when a carrier was forced to travel some distance empty, since he was not equipped to carry the type cargo available.

In response to the growing demand for a simple method of transferring cargo from one mode of surface transport to another, intermodal containers have been developed. These containers are designed to meet International Standards Organization (ISO) specifications, and are generally 8 feet high by 8 feet wide by 10 to 40 feet long, in 10 foot increments. Generally use of this type of container has been with various means of surface transport, however, it has seen limited use in air transport. Recently lightweight containers of this type, specifically for air shipment, have become available.

Backhaul difficulties arise when a carrier transports, for example, solid cargo in one direction and is then forced to make the return trip empty since only fluent materials are available for shipment. Some efforts have been directed toward converting these carriers from one type of cargo to another, however such systems require not only a substantial amount of idle time for the carrier during conversion, but also a large amount of freight depot storage at each end of the route for the necessary hardware. Frequently, an excess of one type of hardware is stored at one end of the route, while the need for the hardware is at the other.

It has been suggested that these difficulties may be overcome by providing self-contained, convertible cargo containers. Typical prior efforts in this regard utilize, for example, a collapsable liner directly supported by the walls of the outer container and held in position by a bulky linkage assembly. Since such containers are generally intended for use by surface transport means, little effort appears to be directed toward minimizing weight and bulk.

A related problem in the design of a convertible container is the different densities of solid and fluent cargo. Since fluent material, such as a liquid, is far more dense than solid cargo, a conversion design must compensate therefor by providing a smaller fluent container supported to evenly distribute the load. This factor is extremely critical in air transport where pressure of the liquid is accentuated by high acceleration forces during flight maneuvers.

One object of the present invention is to provide an intermodal container that may be quickly and efficiently converted from one type of cargo storage to another using elements and hardware that are always stowed within the container.

Another object of the invention is to provide a convertible container system wherein an inner, fluent material container may be removed and compactly stored so as to be efficiently transported by the carrier when not in use.

Yet another object of the present invention is to provide a convertible container system whereby all of the hardware necessary for converting the container from solid to fluent storage will either move out of the way within the container or be mounted and dimensioned so as to be removable from several containers and nestable within a single container.

It is another object of the invention to provide a convertible, intermodal container capable of utilizing the maximum allowable cargo density regardless of the type of cargo carried.

Another object of the invention is to provide a container capable of holding solid cargo on one end and fluent cargo on the other end.

A related object of the invention is to provide a convertible, intermodal container system wherein all elements and hardware necessary for conversion are carried with the transport, thus eliminating the necessity of destination storage.

SUMMARY OF THE INVENTION

The present invention overcomes the aforementioned problems and disadvantages by providing a standard or lightweight cargo container that may be easily and quickly converted from one storage mode to another. An inner, preferably cylindrical container supporting an impermeable bag or liner is positionable within an outer container to hold fluent material. This inner container is supported from the stable edges of the outer container, which in turn is locked to the aircraft floor in a known manner. The inner-container may be quickly removed or pivoted to a stowed position whereby the outer container may be used for solid cargo.

BRIEF DESCRIPTION OF THE DRAWINGS

FIG. 1 is a cross-sectional view of one embodiment of the instant invention showing the container configured to transport fluent material.

FIG. 2 illustrates the manner in which several fluent container elements may be stored for backhaul when not in use.

DESCRIPTION OF THE PREFERRED EMBODIMENTS

Figure 3:
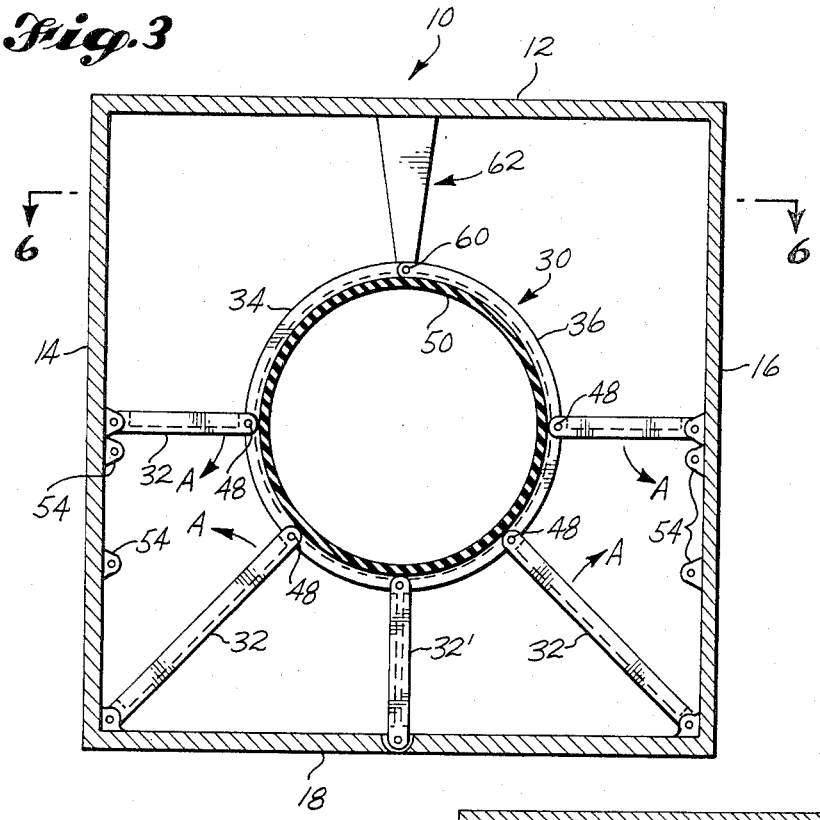
FIG. 3 is a cross-sectional view of another embodiment of the instant invention wherein the inner fluent container elements may be pivoted to a stowed, out of the way position within the outer container when not in use.

Referring first to FIGS. 1–2 an intermodal container, generally designated 10, is shown. Container top wall 12, side walls 14, 16, bottom wall 18 and end walls 20, 22 (FIGS. 6, 7) respectively, may be of any well known lightweight construction, such as for example, fiberglass, skin/stringer arrangement, honeycomb material or corrugated light metal alloys. In FIG. 1, container 10 is configured for carrying fluent material. As used herein, "fluent" is intended to encompass granular, powdery or gritty materials as well as liquids. In this configuration, a generally cylindrical, open ended container 30 is supported within container 10 by links or supports 32, 32', 32". Container 30 may be formed of two or more shell sections 34, 36. Sections 34, 36 may extend the full length of container 10 or may be divided into a plurality of axially extending segments. Such segments not only simplify handling during conversion, but also permit both fluent and solid cargo to be carried in the same container 10, as will be discussed in greater detail infra, with reference to FIG. 8. Shell sections 34, 36 are secured together by one or more removable pins 38 which extend through holes 40 in bosses 42 and flange 49 (see FIGS. 6 and 7). Other, known means of providing an easily releasable connection could, of course, be used.

Links or supports 32, 32', 32" are pivotally mounted by brackets 44 to the inside of top, side and bottom walls 12, 14, 16, 18 by pins 46. Note bracket 44 for link 32' is recessed into wall 18. Pins 46 may extend the entire length of container 10 or may be longitudinally divided into a plurality of segments which are complimentary in length to shell segments 34, 36. In either arrangement pins 46 may be removable to permit withdrawl of links 32, 32', 32". Links 32 are also removably attached to shell sections 34, 36 by removable pins 48 passing through holes in bosses 47 and flange 49 or any of a variety of well known easily removable coupling means. Links 32', 32" are removably attached to sections 34, 36 by aforementioned pins 38. With shell sections 34, 36 secured together and links 32, 32', 32" attached, container 30 serves to support one or more liners or bags 50, which may be formed for example, of rubber or other flexible, impervious material. Bag 50 will be discussed in greater detail infra, with reference to FIGS. 6–8. The end walls 20, 22 (FIGS. 6, 7) of container 10, or an auxiliary wall 52 (FIG. 8), serve as the end walls of container 30 and confine bag 50 therein. Of course, when required by higher pressure, e.g. liquified gases, dome-shaped end plates may be provided.

A typical density range of solid cargo completely filling an intermodal container intended for air transport, dimensioned to ISO specifications of 8 feet by 8 feet by 20 feet, is approximately 10–20 lb/ft$^3$. In the fluent mode, a container 10, carrying an inner container 30 having a diameter of approximately 4 feet and filled with a liquid of approximately 45–90 lb/ft$^3$ density, exhibits an equivalent dry cargo density of approximately 10–20 lb/ft$^3$. It is therefore clear that container 30 could of course have other dimensions or be less than completely filled, depending on the density of the fluent cargo to be carried, that maximum gross weight of the container and the structural limits of the mode of transport concerned.

When solid cargo is to be transported, container 10 may be quickly converted to that mode. Container 30 and bag 50 may be removed from container 10 by removing pins 38 and 48. For ease in handling, it may be desirable to separate the shell sections and/or segments prior to removal. After container 30 has been removed, links 32, 32" are pivoted in the direction of arrows A against the inside of walls 12, 14 and 16 of container 10. Brackets 54, adapted to accept a coupling such as pin 48, are provided to hold links 32, 32" in stowed position against walls 12, 14 and 16. Link 32' is preferably removed from lower wall 18 and stowed against a side wall 14, e.g. by providing additional brackets (not shown) on one of links 32, or in some other convenient location. In this manner the bottom wall 18 is left clear so as to provide easier access to the interior of container 10 for loading by, e.g., a forklift.

Shell sections 34, 36 are stacked or nested on one side of a container 10 while bags 50 are stacked on the other, as shown in FIG. 2. In this manner all necessary hardware for fluent cargo is carried for backhaul with minimal loss of solid cargo transport capacity. Of course breakdown into smaller segments can improve stacking efficiency.

Figure 4:
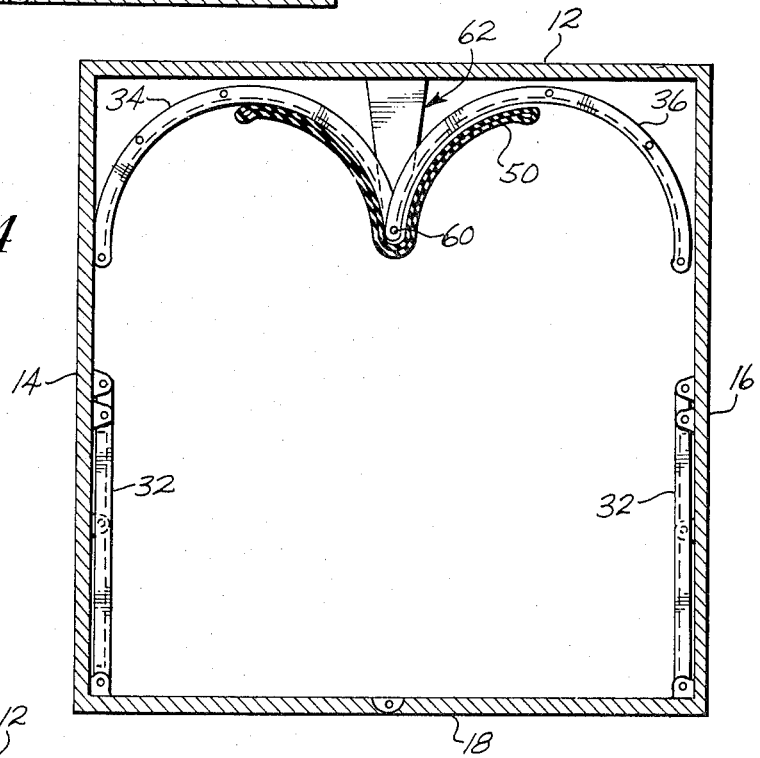
FIG. 4 is a cross-sectional view of the embodiment of FIG. 3 converted to the solid cargo mode.
Figure 5:
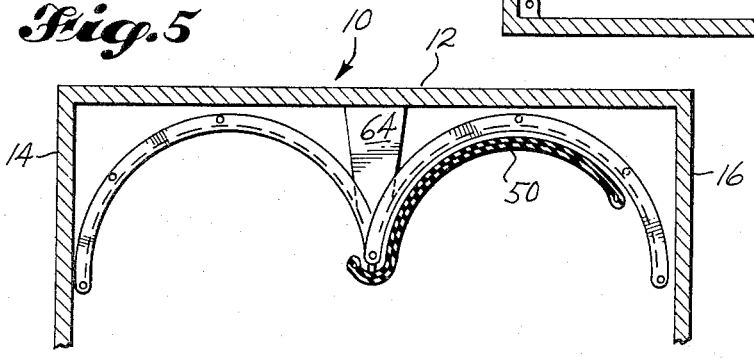
FIG. 5 is a view similar to 4 showing a different storage position for the fluent bag or liner.
Figure 6:
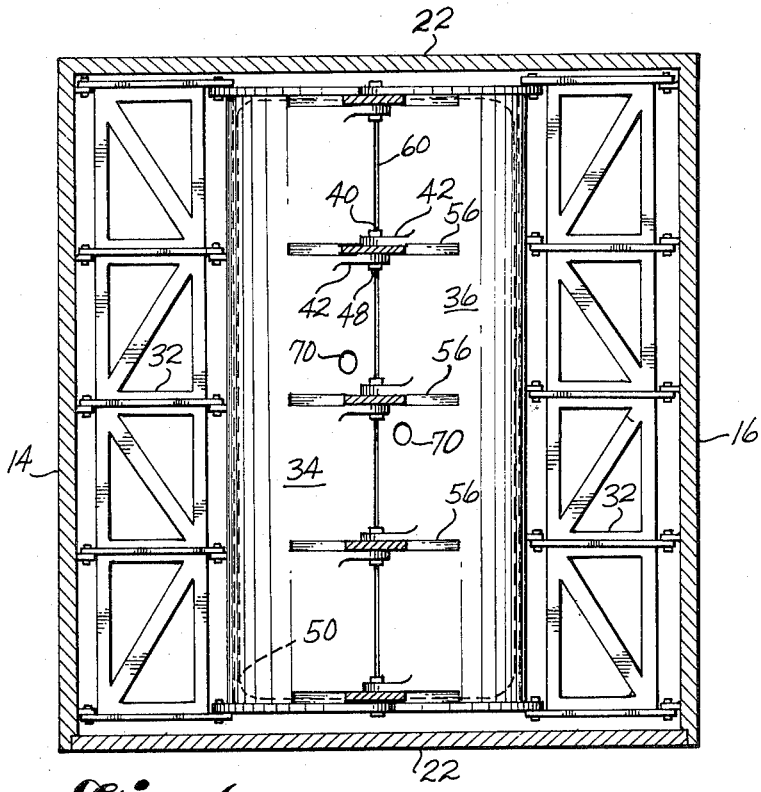
FIG. 6 is a top view taken along lines 6—6 of FIG. 5 showing the connection or hinge line for two shell sections.

Turning now to FIGS. 3–7 there is shown another embodiment of the invention wherein conversion from fluent (FIG. 3) to solid (FIG. 4) mode is accomplished by pivoting shell sections 34, 36 about pivot pin 60. As seen in FIG. 6, pin 60 may extend through holes 40 in bosses 42, so that shell sections 34, 36 may be used in either embodiment of the invention. However, other known pivot arrangements could be used if desired. Bosses 42 are positions to mate with a permanent support bracket generally designated 62, which is made up of individual arms 64 carrying holes for pin 60. Slots 56 are provided in sections 34, 36 to accomodate arms 62. To convert this embodiment of the invention from fluent to solid mode, it is only necessary to remove pins 48 from links 32, 32'. Links 32 are then pivoted (arrows A) against the walls 14 and 16 of container 10 and held there by brackets 54 as discussed supra. Once again the lower link 32' is removed to provide a clear bottom wall or floor area for loading. Shell sections 34, 36 may then be pivoted to their stowed position (FIG. 4) and held there in any convenient manner, e.g., by providing additional brackets similar to brackets 54.

As shown in FIG. 4, in an empty condition, bag 50 collapses and is held out of the way in any desired manner, e.g. by a longitudinally extending rod (not shown) releasably secured to shell sections 34, 36 and pressing bag 50 upwardly along its length. FIG. 5 illustrates another possible storage position for bag 50.

Figure 7:
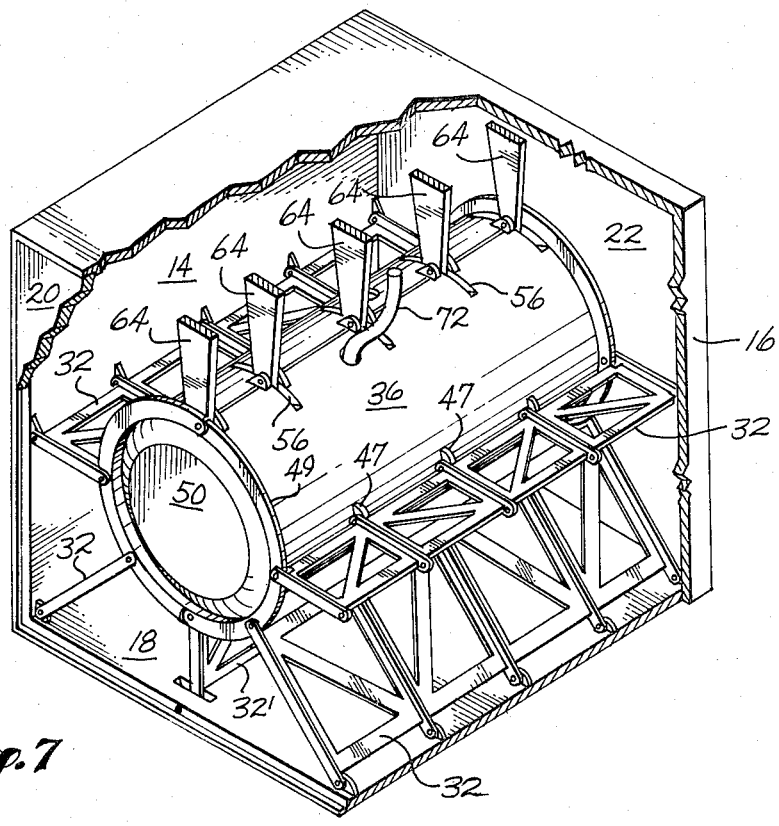
FIG. 7 is a perspective view of the FIG. 3 embodiment illustrating the fluent container and supports.

Bag 50 may be filled and emptied in a variety of ways depending on, e.g. the type of fluent material being carried and the equipment available for such purposes. Openings may be provided through the ends of bag 50, however, for purposes of illustration a top fill arrangement is shown. As shown in FIGS. 6–7, holes 70 may be provided at various locations through shell sections 34, 36. A flexible tube 72 which has been vulcanized or otherwise firmly secured to bag 50 is passed through hole 70 and is attached by any desired means to any one of a plurality of capped openings 74 (only one shown) in upper wall 12. A similar tube (not shown) may be provided in a lower portion of container 30, to provide gravity discharge of the contents. Obviously, this latter tube would need to be disconnected prior to pivoting shell sections 34, 36 to their stowed position. Rigid or accordian-type fill tubes could also be used.

Figure 8:
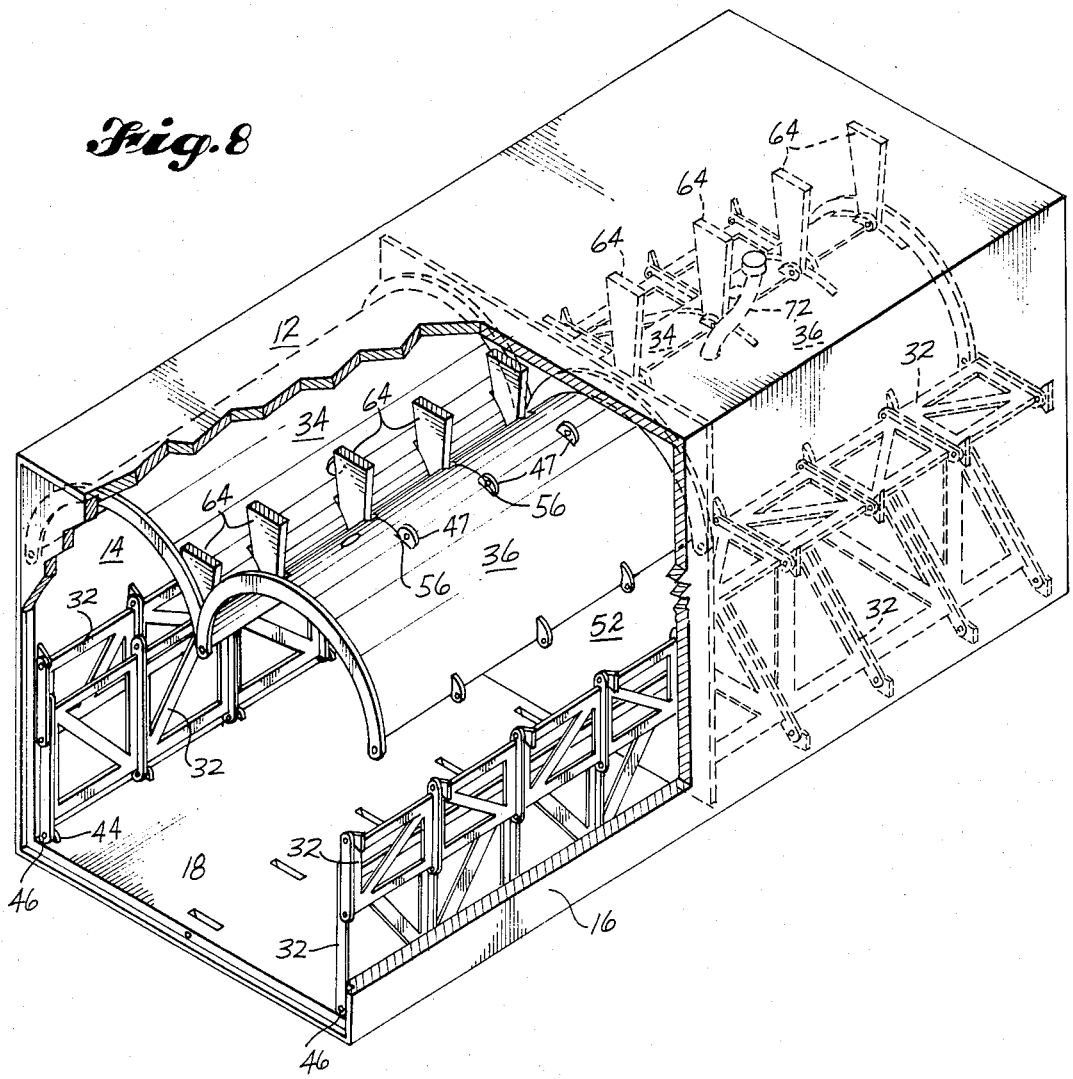
FIG. 8 is a perspective view of another possible arrangement wherein both fluent and solid cargo may be carried in the same outer container.

FIG. 8 illustrates a slightly different arrangement of the invention whereby both fluent and solid cargo may be carried at the same time in the same container. An auxiliary wall 52 is provided to serve as an end wall for shortened container 30, which is created by moving less than all segments 34, 36 into fluent storage position. Of course a bag 50 of reduced length would be necessary for such an arrangement. Auxiliary wall 52 could, for example, be stored at one end of container 10 when not in use. Although this divided version of the invention is illustrated with the embodiment of FIG. 3, it should be apparent that a similar version could be created with the embodiment of FIG. 1.

It is clear that the instant invention provides an efficient and easily converted cargo container capable of great flexibility. In this way more efficient use of both the carriers time and dwindling fuel resources is provided.

Variations and modifications will occur to persons skilled in the art without departing from the spirit and scope of the invention. Accordingly it is intended that the appended claims cover all such variations and modifications.

We claim:

1. A cargo container convertible between a solid storage mode and a fluent storage mode comprising top, bottom and side walls forming a generally rectangular outer container;

an end wall at each end of said outer container substantially closing said outer container;

an inner container mounted within said outer container, said inner container comprising at least two curved circumferentially divided shell sections and means to releasably attach said sections to each other to form an open-ended cylinder, said end walls substantially closing said cylinder ends support means pivotally mounted to said outer container and detachably mounted to said inner containner whereby said support means can be easily detached from said inner container during conversion from fluent to dry mode.

2. A container as defined in claim 1 wherein said sections are dimensioned so as to be nestable, one within the other after removal from said outer container.

3. A container as defined in claim 1 wherein said cylinder has a longitudinal axis; said shell sections are divided into a plurality of segments at spaced locations along said axis; and said support means are divided into longitudinal segments at the same locations.

4. A container as defined in claim 3 further including at least one auxiliary wall positionable between said segments such that one portion of said cargo container may be in a fluent storage mode while another portion is in a solid storage mode.

5. A container as defined in claim 4 further comprising an impermeable liner detachably mounted within said cylinder.

6. A container as defined in claim 1 said inner container further comprising a flexible impermeable liner detachably mounted within said cylinder, at least when said cargo container is in a fluent storage mode; and means providing fluent communication between the interior of said liner and the exterior of said outer container.

7. A container as defined in claims 1, 2 or 6 further comprising a permanent support mounted to said top wall, means on said permanent support for pivotally mounting said at least two shell sections and means for holding said shell sections in a stowed, out of the way position when said cargo container is in a solid mode.

8. A container as defined in claim 4 wherein said liner is elastomeric.

9. A container as defined in claim 2 further comprising means mounted on said side walls, within said outer container, for retaining some of said support means in a stowed, out of the way location against said side walls when said container is in a solid storage mode.

10. A container as defined in claim 10 wherein at least one of said support means is detachably mounted to said bottom wall.

11. A container as defined in claim 1 wherein said top, bottom side and end walls are aluminum alloy.

12. A container as defined in claim 1 wherein said top, bottom, side and end walls are of skin and stringer construction.

* * * * *